United States Patent [19]

Loy

[11] 4,279,394

[45] Jul. 21, 1981

[54] SWALLOWTAIL KITE

[76] Inventor: John W. Loy, P.O. Box 1281, Bartlesville, Okla. 74003

[21] Appl. No.: 43,108

[22] Filed: May 29, 1979

[51] Int. Cl.[3] ..... B64C 31/06

[52] U.S. Cl. ..... 244/153 R

[58] Field of Search ..... 244/153 R, 154, 155 A; D21/88, 89

[56] References Cited

U.S. PATENT DOCUMENTS

| | | | |
|---|---|---|---|
| 2,737,360 | 3/1956 | Allison | 244/153 R |
| 3,952,975 | 4/1976 | Laske | 244/153 R |
| 4,081,158 | 3/1978 | Pearce | 244/153 R |

FOREIGN PATENT DOCUMENTS

| | | | |
|---|---|---|---|
| 1512270 | 5/1978 | United Kingdom | 244/153 R |

*Primary Examiner*—Charles E. Frankfort
*Attorney, Agent, or Firm*—James H. Chafin

[57] ABSTRACT

A kite of the swallowtail sled type, comprising a central panel, or canopy of light-weight sheet material, such as paper or thin plastic film, generally in a rectangular shape. It has two long parallel sides, with shorter leading and trailing edges. The leading edge is similar to a shallow isosceles triangle. The trailing edge is cut away also in the form of an isosceles triangle but with the height of the triangle greater than that of the leading edge. Two triangular lateral panels are attached, one to each of the sides of the central panel. At least three slender stiffening battens are attached, one to each of the long sides of the central canopy and one along the center line. A tension cord means or halter, shorter than the width of the central panel is tied between the trailing ends of the two battens.

7 Claims, 3 Drawing Figures

SWALLOWTAIL KITE

CROSS-REFERENCE TO RELATED APPLICATION

This application is related to my co-pending application, filed on the same date as this application, entitled: Hooded Kite, Ser. No. 043109, filed on May 29, 1979.

BACKGROUND OF THE INVENTION

1. Field of the Invention.

This invention lies in the field of kites. More particularly it concerns improvements in a type of kite called a sled. The improvements tending to make the kite fly more smoothly, even in turbulent wind and to fly at a shallower angle of attack, and thus at greater elevation, to avoid collapse, than prior art models.

2. Description of the Prior Art.

The prior art is described in books, such as that by Brummitt, entitled "Kites", Golden Press, New York, New York 1971.

In the prior art there have been examples of sled type kites which are principally rectangular sheets of thin material stiffened by two parallel strips or battens one on each of the longitudinal edge of the sheet of the central panel. There are two triangular side panels or laterals with bases that equal in length to the long sides of the central panel and attached thereto. Cords are attached to each of the points of the side panels and these are joined together to form a bridle. The bridle is attached to a flight line in a conventional manner.

These kites have been shown to be sensitive to collapse in turbulent wind. They also tend to fly at a high angle of attack, providing small lift-to-drag ratio, and thus fly at low elevation.

SUMMARY OF THE INVENTION

It is the primary object of this invention to provide an improved kite of the sled type, which has superior flying characteristics with extremely simple construction.

A further object of this invention is to improve the collapse resistance of the sled type kite.

These and other objects are realized, and the limitations of the prior art are overcome in this invention, by making several important modifications to the basic design of the sled type kite.

In this invention the shape of the central panel has been altered from a rectangle, to one which is the shape of a swallowtail. That is, along the central axis of the central panel, the leading edge has been moved forward a selected distance in the shape of an isosceles triangle. The trailing edge has been cut back also in the shape of an isosceles triangle. However, the lead of the trailing edge is greater than the lead of the front edge. This provides for a projecting front tip of the central panel that is in the clear, and is well adapted to catch the wind and to reinflate the kite if it should collapse. The modification to the trailing edge provides enough opportunity for the wind to spill over the trailing edge and provides additional stability to the flying.

A further improvement of this invention lies in the use of a cord in tension, or halter, across the trailing ends of the two outboard stiffening battens. The length of the cord is of the order of 0.6 of the nominal width of the central panel. This forces the sheet into a trough even with the slightest wind, and therefor provides a stronger reaction of the kite at low wind velocities.

Because of the triangular shape of the leading edge, it is necessary to have a third stiffening rod or batten along the axis of the central panel, or canopy, to support the point.

BRIEF DESCRIPTION OF THE DRAWING

These and other objects and advantages of this invention, and a better understanding of the principles and details of the invention, will be evident from the following description, taken in conjunction with the appended drawing in which.

DESCRIPTION OF THE PREFERRED EMBODIMENT

Figure 1:
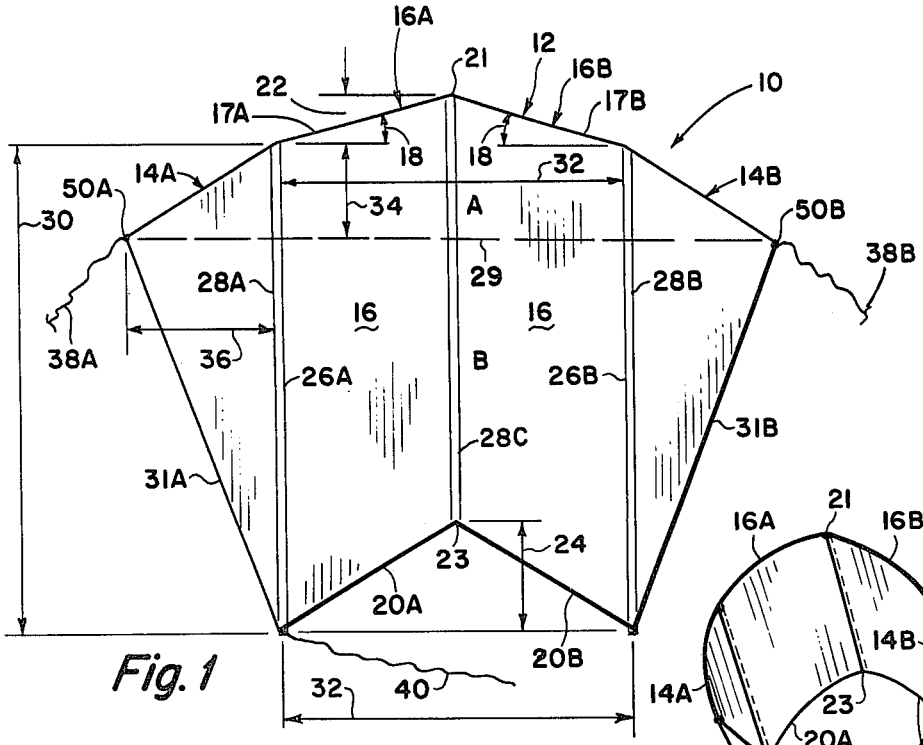
FIG. 1 illustrates one embodiment of the improved kite of this invention.

Referring now to the drawings, and in particular, to FIG. 1, there is shown a plane view of one embodiment of this invention, indicated generally by numeral 10. The kite 10 comprises a central panel or canopy indicated generally by the numeral 12, which has two long sides 26A and 26B, which are attached to two longitudinal stiffening battens 28A and 28B.

The embodiment shown in FIG. 1 has a central stiffening batten 28C along the longitudinal axis of the canopy, and the smaller sub-panels are mirror images of each other, and are identified by the numerals 16A and 16B.

In this embodiment the leading edge is a broken line, made up of two segments 17A and 17B, joined together at the central tip 21 of the canopy. The lines 17A and 17B form the two equal sides of a shallow isosceles triangle, the base of which is equal to the width 32 of the canopy at the front ends of the battens, 28A and 28B.

The trailing edge is similarly cut back in the form of an isosceles triangle, the two equal sides of which are 20A and 20B, which join together at point 23 which is at the trailing edge of the central batten 28C. The height of the rear triangle is indicated at 24, which is of greater dimension than the height 22 of the leading edge triangle. Thus the central batten is shorter than the two side battens.

Figure 3:
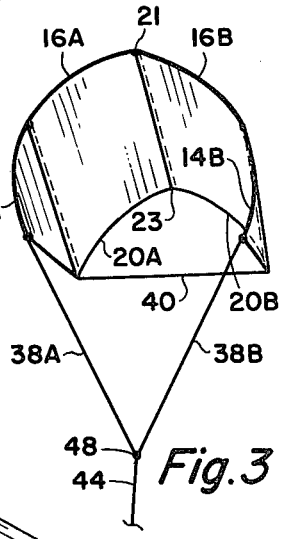
FIGS. 2 and 3 show the general configuration of the kite while in flight.
Figure 2:
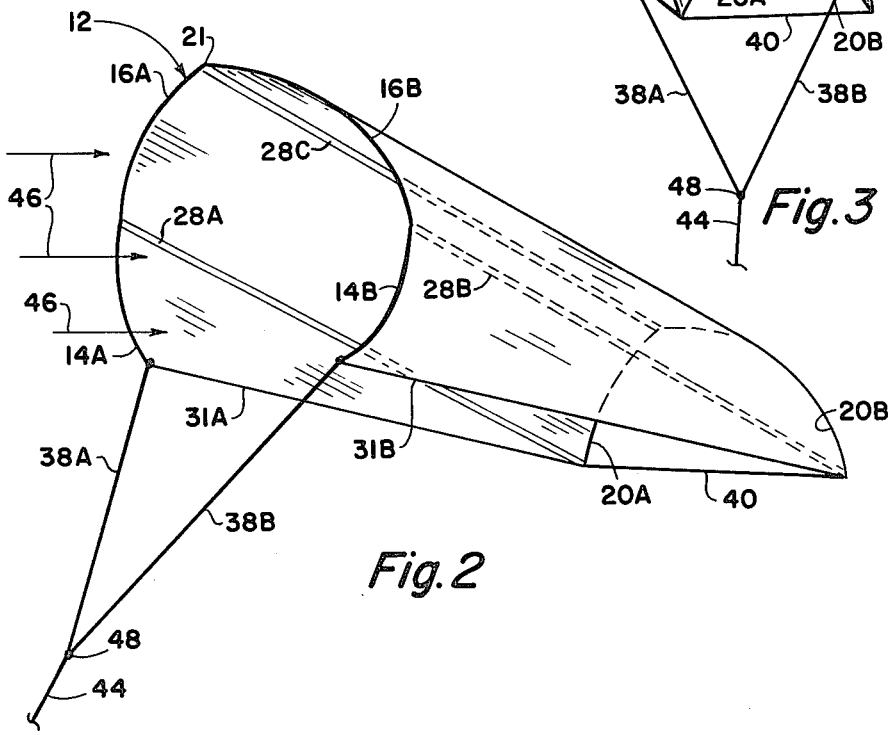

There are two side panels or laterals, indicated generally by the numerals 14A and 14B. The bases of these triangles are equal in length to the side edges of the canopy and are attached thereto. The points 50A and 50B of the side laterals 14A and 14B are closer to the leading edge 17A, 17B of the kite, than to the trailing edge, 20A, 20B. Means are provided to attach two cords 38A and 38B at these two tips of the laterals, which, as shown in FIGS. 2 and 3, can be joined together at point 48, and to a flight line 44, so as to provide a bridle, to hold the side panels somewhat parallel to each other. Thus there would be a more-or-less semi-cylindrical shape to the canopy when there is at least a weak wind blowing into the underside of the kite.

A tension member or halter 40, which may be a cord, is tied between the two trailing ends of the side battens 28A, 28B. The length of the halter can be in the range of 50% to 70% of the width 32 of the canopy at the trailing edge. A preferred value is 60% of 32.

Like conventional models of the sled type kites, this embodiment has no lateral stiffening members.

So far as general dimensions are concerned, the kite can of course be made of any desired size, however some general ratio of dimensions are preferred as follows.

The width 32 is in the range of 0.75 to 0.85 of the length 30 with a preferred value of 0.8. The dimension 36 is in the range of 0.2 to 0.35 of the length 30. The dimension 34 is in the range of 0.2 to 0.3 of the length 30. The position of the points of attachment 50A, 50B of the bridle should be such that a line drawn between these points, such as dashed line 20 will divide the area of the canopy into two areas, a front area A, and a rear area B, such that the ratio of A to the total area (A & B) is in the range of 0.25 to 0.35, with a preferred value of 0.3.

In the sled type kites their greatest difficulty is their tendency to collapse. If wind conditions are so unfavorable as to cause a collapse, the kite of this invention automatically reopens without the need for manipulation of the flying line by the flyer. This occurs because in a collapsed state, with the two outboard battens and most of the canopy brought together, and parallel to the wind, the center batten and apex area still catch the wind and cause the entire canopy to reopen. The whole episode of collapse and reopening usually occurs in a time interval of less than two seconds.

I have found that an additional contributor to collapse is the fact that the battens are floppy at the trailing end. Even in mild turbulence, they occasionally flop outwardly, simultaneously both spilling the necessary pressure on the windward side of the canopy, and also causing the leading ends of the battens to come together. The result is collapse. This is prevented by the use of the halter 40 that ties the trailing ends of the battens with a fixed maximum spacing.

FIGS. 2 and 3 show views of the kite of FIG. 1 under flying conditions, with the wind blowing in accordance with arrows 46 for example. It will be seen that the bridle 38A, and 38B tends to hold the side panels more or less parallel, therefore forming the kite into a cylindrical shape. The halter 40 aids this by limiting the maximum spacing between the trailing ends of the side battens.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A kite of the sled type, comprising:

(a) a central canopy of light sheet material; generally in a rectangular shape, with two long parallel sides with shorter leading and trailing edges;

(b) the leading edge cut on a broken line forming a shallow first isosceles triangle, with its base at the front ends of the two sides, and the center peak ahead of the central canopy;

(c) the trailing edge cut in a broken line in the shape of second isosceles traingle with the base at the trailing ends of the two sides; and the central peak ahead of the trailing ends of the two sides; the height of the second triangle greater than the height of the first triangle;

(d) a left side panel of triangular shape with its long edge equal in length to, and attached to, the left side of the central canopy; and a similar triangular side panel with its long edge attached to the right side of the central canopy; said side panels made of light sheet material;

(e) at least three slender battens, one attached to each side of the central canopy and a third along the center line of the central canopy;

(f) a cord bridle, the two ends of the cord attached one to each of the tips of said side panels; and (g) a flexible halter, shorter than the width of said central canopy, tied between the trailing ends of said two outboard battens.

2. The kite as in claim 1 in which the width of said central canopy is in the range of 0.75 to 0.85 of the length of said central canopy.

3. The kite as in claim 2 in which the width of said central canopy is approximately 0.8 of the length of said central canopy.

4. The kite as in claim 1 in which the length of said flexible halter is in the range of 0.5 to 0.7 of the width of said central canopy, at the trailing edge.

5. The kite as in claim 4 in which the length of said flexible halter is approximately 0.6 of the width of said central canopy.

6. The kite as in claim 1 in which the width of said side panels is in the range of 0.3 to 0.35 of the length of said central canopy.

7. The kite as in claim 1 in which the tips of said side panels are positioned in the range of 20–30% of the length of said central panel back from said leading edge.

* * * * *